US007946790B2

(12) United States Patent
Casola et al.

(10) Patent No.: US 7,946,790 B2
(45) Date of Patent: May 24, 2011

(54) INSTALLATION COMPRISING AT LEAST TWO BOTTOM-SURFACE CONNECTIONS FOR AT LEAST TWO UNDERSEA PIPES RESTING ON THE SEA BOTTOM

(75) Inventors: Floriano Casola, Gazzada schianno (IT); Henri Jacques Wattez, Brest (FR); Giuseppe Attanasio, Robecchitto-con-Induno (IT); Garry Mahoney, Le Vesinet (FR)

(73) Assignee: Saipem S.A., Montigny le Bretonneux (FR)

( * ) Notice: Subject to any disclaimer, the term of this patent is extended or adjusted under 35 U.S.C. 154(b) by 405 days.

(21) Appl. No.: 11/990,791

(22) PCT Filed: Aug. 25, 2006

(86) PCT No.: PCT/FR2006/001991

§ 371 (c)(1),
(2), (4) Date: Feb. 21, 2008

(87) PCT Pub. No.: WO2007/023233

PCT Pub. Date: Mar. 1, 2007

(65) Prior Publication Data

US 2009/0103985 A1 Apr. 23, 2009

(30) Foreign Application Priority Data

Aug. 26, 2005 (FR) ..... 05 08773

(51) Int. Cl.
*F16L 1/16* (2006.01)

(52) U.S. Cl. ..... 405/169; 405/223; 166/359; 166/367

(58) Field of Classification Search ..... 405/158, 405/169, 224, 224.1, 224.2, 224.3; 166/345, 166/350, 359, 367
See application file for complete search history.

(56) References Cited

U.S. PATENT DOCUMENTS 3,911,688 A * 10/1975 Behar et al. ..... 405/171
4,388,022 A * 6/1983 Gentry et al. ..... 405/224.3
4,391,332 A 7/1983 Fayren
4,423,984 A * 1/1984 Panicker et al. ..... 405/224.3
(Continued)

FOREIGN PATENT DOCUMENTS

WO WO 00/08262 2/2000
(Continued)

*Primary Examiner* — Tara Mayo-Pinnock
(74) *Attorney, Agent, or Firm* — Cohen Pontani Lieberman & Pavane LLP

(57) ABSTRACT

A bottom-surface connection installation for at least two undersea pipes resting on the sea bottom, the installation comprising: a first hybrid tower having a vertical riser anchored to a first base and connected to an undersea pipe resting on the sea bottom and having its top end connected to a first float below the surface, and a first connection pipe, preferably a flexible pipe, providing a connection between a floating support and the top end of said riser; and at least one second rigid pipe rising from the sea bottom where it rests or from a second undersea pipe resting on the sea bottom and to which its bottom end that is not anchored to said first base is connected, up to below the surface, where its top end is connected to a second float situated at substantially the same depth as said first float, and fastened to said first float to at least one respective said connection pipe that is flexible and serves to connect it to the same said floating support.

19 Claims, 7 Drawing Sheets

U.S. PATENT DOCUMENTS

| | | | | |
|---|---|---|---|---|
| 4,643,614 | A * | 2/1987 | Laursen | 405/169 |
| 4,762,180 | A * | 8/1988 | Wybro et al. | 166/350 |
| 4,848,949 | A * | 7/1989 | Castel | 403/12 |
| 6,854,930 | B2 | 2/2005 | Pionetti | |
| 7,191,836 | B2 * | 3/2007 | Bhat et al. | 166/355 |
| 2004/0129425 | A1 * | 7/2004 | Wilson | 166/359 |
| 2005/0063788 | A1 * | 3/2005 | Clausen | 405/224.2 |

FOREIGN PATENT DOCUMENTS

| | | | |
|---|---|---|---|
| WO | WO 00/49267 | | 8/2000 |
| WO | WO 02/066786 | A1 | 8/2002 |
| WO | WO 02/103153 | | 12/2002 |
| WO | WO 03/097990 | A1 | 11/2003 |
| WO | WO 03/102350 | A2 | 12/2003 |
| WO | WO 2004/003575 | A1 | 4/2004 |

* cited by examiner 13-1
13
6-1
6-2
2a
2b
5
1a
1b
L1
β
19
14
3a
3b
12
z
o
x
α

11

2a
2b 4a
z
o
x
7
γ<0
z
o
y
1a
α
1a
1b
3a
3b
12
10a
3a
12

13-1
13
6-1
7
2a
2b
A
A
6-2
7
1b
1a
10a
3a
12
3b'
10b

2a
X
6-1,6-2
8-2
Y
Y
1b
8-1
2b
X

X
2b1
1b1
δ
2a1
Y
Y
δ
2a2
X
6-1,6-2
2b2
1b2

INSTALLATION COMPRISING AT LEAST TWO BOTTOM-SURFACE CONNECTIONS FOR AT LEAST TWO UNDERSEA PIPES RESTING ON THE SEA BOTTOM

PRIORITY CLAIM

This is a U.S. national stage of application No. PCT/FR2006/001991, filed on 25 Aug. 2006. Priority is claimed on the following application(s): Country: France, Application No. 05/08773, Filed: 26 Aug. 2005; the contents of which is incorporated here by reference.

BACKGROUND OF THE INVENTION

The present invention relates to an installation comprising multiple bottom-surface connections for at least two undersea pipes resting on the sea bottom, and in particular pipes situated at great depth, the installation comprising at least one hybrid tower.

The technical field of the invention is more particularly the field of fabricating and installing rising production columns or "risers" for extracting oil, gas, or other soluble or fusible materials or a suspension of mineral material from under the sea via an immersed well head and up to a floating support, for the purpose of developing production fields installed offshore, at sea. The main and immediate application of the invention lies in the field of producing oil.

In general, the floating support has anchor means for keeping it in position in spite of the effects of currents, winds, and swell. It also generally has means for storing and processing oil, together with means for off-loading oil to oil-removal tankers, which call at regular intervals for the purpose of taking away the production. Such floating supports are commonly referred to as floating, production, storage, off-loading supports as they are referred to below by the abbreviation "FPSO".

Bottom-surface connections are known for an undersea pipe lying on the sea bed, where such a connection may be of the so-called hybrid tower type, comprising:

- a vertical riser having its bottom end anchored to the sea bottom and connected to a said pipe resting on the sea bottom, with its top end tensioned by a float that is immersed under the surface and to which it is connected; and
- a connection pipe, generally a flexible connection pipe, between the top end of said riser and a floating support on the surface, said flexible connection pipe, where appropriate, taking up the shape of a plunging catenary under the effect of its own weight, i.e. a catenary that drops well below the float before subsequently rising up to said floating support.

Bottom-surface connections are also known that are implemented by raising strong and rigid pipes made up of thick-walled tubular elements welded or screwed together continuously up to beneath the surface in a catenary configuration with curvature that is continuously varying along the entire length in suspension, and commonly referred to as steel catenary risers (SCRs), and also commonly referred to as "catenary type rigid pipes" or as "SCR type risers".

Such a catenary pipe can rise to a floating support on the surface or merely up to a float under the surface that tensions its top end, with said top end then being connected to a floating support by a plunging flexible connection pipe.

Catenary risers of reinforced configuration are described in WO 03/102350 in the name of the Applicant.

In WO 00/49267 in the name of the Applicant, proposals are made to use SCR type rigid pipes for a connection pipe between the floating support and the riser having its top tensioned by a float immersed under the surface, and the float is installed at the head of the riser at a considerable distance below the surface, and in particular at a depth of at least 300 meters (m) below the surface, and preferably at least 500 m.

In WO 00/08262 (D1) and WO 03/097990 (D2), proposals are made for installations having two rigid catenary pipes of the SCR type, each rising up to a respective float that is immersed below the surface, with the top ends of said rigid SCR type pipes being connected respectively to two plunging flexible pipes providing connections between said rigid SCR pipes and a floating support. Those two bottom-surface connections are disposed symmetrically relative to each other and at substantially the same depth, both concerning the top end of the SCR and concerning the connection point and the curve formed by each of said flexible pipes.

In WO 00/08262, the installation is particularly unstable and is subjected to large amounts of movements by swell and currents, such that such an installation can be envisaged only when the pipes are of the flexible pipe type and not of the SCR pipe type since they would present wear phenomena in their ground contact point zones, which are their zones subjected to the highest levels of stress, that are completely incompatible with operating for a lifetime of 10 years or even 30 years.

In WO 03/097990, the installation is more stable since each of the floats is anchored to the sea bottom by a tie. Furthermore, the horizontal connection between the floats is also constituted by a tie of considerable weight, and thus occupying a catenary configuration. That creates horizontal tension that compensates the horizontal tension from each of the catenary-shaped SCR type pipes. However the assembly thus presents a very high degree of flexibility, which is incompatible with long-term strength for a rigid SCR type pipe, in particular in the vicinity of the zone where it makes contact with the ground.

In those two patents, the two bottom-surface connections, and in particular the two floats, are spaced apart from each other by a considerable distance in order to avoid any collisions during the movements of the two floats and the two flexible pipes in their respective movements under the effect of the displacements of the floating support and/or the swell, wind, and currents.

It is desired to implement as many bottom-surface connections as possible from a single floating support in order to optimize the working of oil fields. That is why various systems have been proposed enabling a plurality of vertical risers to be associated with one another in order to reduce the area or "footprint" occupied over the operating fields and in order to enable a larger number of bottom-surface connections to be connected to a single floating support. Typically, it is necessary to be able to install up to 30 or even 40 bottom-support connections from a single floating support.

In WO 00/49267, there is described a multiple hybrid tower comprising an anchor system with a vertical tendon constituted either by a cable, or by a metal bar, or indeed a pipe tensioned at its top end by a float. The bottom end of the tendon is fastened to a base that is resting on the bottom. Said tendon includes guide means distributed along its entire length and through which there pass a plurality of said vertical risers. Said base may merely be placed on the sea bottom and stay in place under its own weight, or it may be anchored by means of piles or any other device suitable for keeping it in place. In WO 00/49267, the bottom end of the vertical riser is suitable for being connected to the end of a bent sleeve that is movable between a high position and a low position relative to said base, from which said sleeve is suspended and is associated with return means urging it towards its high position in the absence of a riser. This ability of the bent sleeve to move serves to absorb variations in the length of the riser under the effects of temperature and pressure. At the head of the vertical riser, an abutment device secured thereto bears against the support guide installed at the head of the float and thus serves to keep the entire riser suspended.

The connection with the undersea pipe resting on the sea bottom is generally provided by means of a portion of pipe having the shape of a pig's tail or of the letter S, with said S-shape then being made either in a vertical plane or in a horizontal plane, the connection with said undersea pipe generally being made via an automatic connector.

That embodiment having a multiplicity of vertical risers held by a central structure comprising guide means is relatively expensive and complex to install. Furthermore, the installation needs to be prefabricated on land before being towed out to sea, and then once on site, it needs up-ending in order to be put into place. In addition, maintenance thereof also involves relatively high operating costs.

In WO 02/066786 and WO 02/103153 in the name of the Applicant, hybrid towers are described having multiple risers with vertical riser anchor systems suitable for receiving two risers side by side from a common anchor base, with the floats at the top of said risers being secured and fastened together by means of a hinged structure in the form of a parallelogram. The two risers are also connected together with the help of tubular collars fastened on one of the risers and connected by rings that slide freely around the second riser so that the two risers can perform substantially the same lateral movements while being relatively more independent when performing vertical movements.

When it is desired to associate a plurality of risers with a common floating support, a problem of interference occurs between the movements of said risers, which risers are subjected to the same movements as their respective top tensioning floats under the effect of the displacements of the floating support on the surface that is subjected to swell, wind, and currents.

The embodiments described above are relatively effective, but they are still too complicated concerning their methods of laying and their maintenance constraints when in use, particularly in the vicinity of the anchor system and also in terms of associating the risers with one another. In addition, and above all, that type of hybrid tower having multiple risers needs to be prefabricated on land before being installed at sea.

Furthermore, when a multiplicity of bottom-surface connections of the hybrid tower type are implemented, each comprising a single vertical riser, it is necessary in practice to space the various connections apart from one another for at least the following two reasons:

1) firstly, the respective bases of two hybrid towers, when anchored by suction anchors engaged in the sea bottom, need to be spaced apart by a distance that is not less than 5 times, and preferably not less than 10 times, the diameter of said anchors in order to avoid interference in terms of the strength of the sea bottom and in order to guarantee reliable anchoring; and 2) furthermore, the floats at the tops of the risers are subjected to displacements within respective cones having their vertices situated at the anchor systems (see FIG. 1) and presenting angles that require sufficient distance to be provided between the various top floats for the vertical risers to ensure that they do not strike one another.

These constraints imply spreading out over the working zone, and they thus limit the number of bottom-surface connections that can be connected to a single floating support, over its sides, in order to avoid interference between the various connections.

Furthermore, the crude oil is conveyed over long distances, several kilometers, so the risers need to be provided with extreme levels of insulation that are very expensive, firstly in order to minimize any increase in viscosity, which would lead to a drop in the hourly production rate from a well, and secondly to avoid the flow becoming clogged by paraffin being deposited, or by hydrates forming on the temperature dropping to around 30° C.-40° C. These phenomena are particularly critical, especially off West Africa, where the temperature at the sea bottom is about 4° C. and the crude oils are of the paraffin type. It is therefore desirable for the bottom-surface connections to be short in length, and thus for the footprints of the various connections connected to a single floating support to be small.

That is why it is desirable to provide an installation that can operate a plurality of bottom-surface connections of the hybrid tower type from a single floating support, with the connections presenting small footprints and moving little and also being simpler to lay and suitable for being fabricated at sea from a pipe-laying vessel, so as to avoid prefabrication on land followed by towing out to site and up-ending in order to put the installation finally into place.

In published application US 2004/0129425, proposals are made to implement a single float connected to a plurality of vertical risers and/or SCR type pipes anchored or resting on the sea bottom, as the case may be. However the system proposed in that patent presents several drawbacks:

firstly, for reasons associated with putting the installation into place, the float needs to present buoyancy characteristics that vary so as to be capable of becoming more and more buoyant as the various SCR riser type pipes plus the flexible pipe are connected sequentially thereto; and secondly, connecting the top of a second vertical riser and/or SCR pipe to a float at the top of a first vertical riser leads to problems of a practical nature that have not been solved and are not even mentioned in that US published patent application.

In this respect, the teaching of that patent application is thus incomplete and speculative. When a vertical riser is put into place at sea on site from a surface vessel fitted in particular with a J-lay tower, which is the most advantageous method, the individual pipe elements or strings are connected one to another on board the vessel and the pipe that is being built up is lowered progressively to the sea bottom, with the first string being anchored to the sea bottom and with the last string including a float that enables the riser to be stabilized in a vertical position.

It is therefore very difficult or even impossible to secure the top end of a second riser (that has not yet been stabilized) to a float that is already installed at the top of a first vertical riser that has already been laid. In addition, in depths of water of 1500 m, differential expansion between said two risers, one of them cold and the other one hot, can amount to several meters, thus making it practically impossible for two of said risers to be put into parallel in the absence of special arrangements either at the tops or at the bottoms of said risers.

Finally, another drawback of the system proposed in that patent application US 2004/0129425 is that the float needs to be pre-dimensioned as a function of some determined maximum buoyancy suitable for tensioning a predetermined number of pipes. However in practice it is desirable to be able to put the various bottom-surface connections into place in a manner that is spread out over time without limits on the final number of pipes being set during initial installation of the system, since that number is generally not known in certain and accurate manner from the beginning.

That multi-pipe tower system needs to be pre-fabricated on land before being put into place at sea. However an object of the present invention is to provide a multi-pipe tower system that can be fabricated at sea from a pipe-laying vessel fitted with a laying tower.

OBJECTS AND SUMMARY OF THE INVENTION

More generally, the object of the present invention is to provide an installation comprising a multiplicity of bottom-surface connections for which the fabrication method, the laying method, and the implementation in terms of maintenance are improved, and more particularly simplified.

Still more particularly, the problem posed by the present invention is thus to provide an installation having a plurality of bottom-surface connections leading to a common floating support, in which the method of laying and the method of putting installations into place makes it possible simultaneously:

- to reduce the spacing between the various bottom-surface connections, i.e. to enable a plurality of bottom-surface connections to be installed in an area that is as small as possible, or in other words with a small footprint, for the purpose, amongst others, of increasing the number of bottom-surface connections that can be installed along the side of an FPSO, without said bottom-surface connections interfering with one another; and
- to make fabrication and installation easy by sequentially fabricating and laying the various pipes from a laying vessel on the surface and fitted with a J-laying tower; and finally
- to optimize implementation of float means when installation is spread out over a long period of time between the various bottom-surface connections being put into place, without it being necessary to know from the beginning the number of connections that are to be put into place, nor their characteristics in terms of dimensions and unit weight.

When the development of an oil field is being planned, the magnitude of the oil reserve is, as yet, known only incompletely, with production at full rate then often subsequently making it necessary, after several years, to reconsider the initial production plans and the associated organization of the equipment. Thus, during initial installation of the systems, the number of bottom-surface connections and the way they are organized is defined relative to estimated requirements, which requirements will almost inevitably be revised upwards after the field has been put into production, either for recovering crude oil, or because it is necessary to inject more water into the reservoir, or indeed in order to recover or to reinject more gas. As the reservoir becomes depleted, it generally becomes necessary to drill new wells for reinjecting water or gas, or indeed to drill production wells in new locations of the field, so as to increase the overall recovery rate, thereby correspondingly complicating the set of bottom-surface connections connected to the side of the FPSO.

Another problem posed by the present invention is to be able to make and install such bottom-surface connections for undersea pipes in great depths, e.g. in depths of more than 1000 m, and of the type comprising a vertical hybrid tower, and in which the fluid being transported needs to be maintained above some minimum temperature until it reaches the surface, while minimizing the number of components that might lose heat, and avoiding the drawbacks created by the individual or differential thermal expansion of the various components of said tower so as to withstand extreme stresses and fatigue phenomena that are cumulative over the lifetime of an installation, which commonly exceeds 20 years.

Another problem of the present invention is also to provide a multiple bottom-surface connection installation with hybrid towers in which the anchor system is very strong and of low cost, and for which the methods of fabrication and positioning of the various elements making it up are simplified and also of low cost, and capable of being performed at sea from a laying vessel.

To do this, the invention provides a bottom-surface connection installation for at least two undersea pipes resting on the sea bed, in particular at great depth, the installation comprising:

1) a first hybrid tower comprising:

a) a first rigid pipe consisting of a vertical riser having its bottom end fastened to a first base anchored to the sea bottom and connected to a first said undersea pipe resting on the sea bottom, and having its top end tensioned in substantially vertical manner by a first float immersed under the surface, preferably at a depth of at least 100 m, to which said top end is connected; and b) a first connection pipe, preferably a flexible pipe, providing a connection between a floating support and the top end of said riser; and 2) at least one second rigid pipe rising from the sea bottom where it rests or from a second undersea pipe resting on the sea bottom and to which its bottom end is connected, to below the surface, where its top end is connected to at least one respective second connection pipe, preferably a flexible pipe, connecting it with the same said floating support.

The installation of the invention is characterized in that:

- the bottom end(s) of said second rigid pipe(s) is/are not anchored to said first base; and
- the top end(s) of said second rigid pipes is/are connected respectively to a second float situated substantially at the same depth as said first float and fastened rigidly to said first float, preferably one against the other.

The term "fastened rigidly" is used herein to mean that both floats are secured to each other in terms of movements by a connection that is rigid, and in particular that any degree of freedom in rotation or in translation for one of the floats relative to the other is eliminated as though they were clamped together.

The installation of the present invention presents a footprint and movements that are small, and stability that is greater than that of bottom-surface connections made up by associating two SCR type pipes as described in the prior art.

This system for placing and arranging co-operation between two rigid pipes, one of which is constituted by a vertical riser, with each pipe having its own float at the top and its own independent anchor, also makes it possible firstly to fabricate the entire installation at sea from a pipe-laying vessel and to simplify the laying of each of them at sea, and secondly imparts to them stability in operation because their floats are fastened together, so that the top ends and the floats move identically, while compliance with the minimum spacing for the ground connection points or bases (even though small) also contributes to stabilizing movements at the tops of the riser(s) and of the rigid catenary pipes.

This makes it possible to bring the floats close together without running the risk of two floats colliding during their respective movements.

The term "vertical riser" is used herein to refer to the theoretical and substantially vertical position of the riser when it is at rest, it being understood that the axis to the riser can be subjected to angular movements relative to the vertical and can move within a cone of angle $\alpha$ having its vertex corresponding to the point where the bottom end of the riser is fastened to said base.

In a first embodiment, the multiple bottom-surface connection installation of the invention comprises a said second rigid pipe constituted by a second vertical riser having its bottom end fastened to a second base anchored to the sea bottom independent from said first base and connected to a second undersea pipe resting on the sea bottom.

Preferably, said base is situated at a distance of no more than 50 m, preferably 25 m to 50 m, from said first base.

More particularly, said first and second bases include suction anchors embedded in the sea bottom.

Thus, the two bottom-surface connections are connected together at the top, but with different anchor points that are spaced apart from each other such that in the event of differential expansion due to different temperatures in each of the vertical pipes, that will lead to deformation of the triangle whose vertex is constituted by the float assembly and whose base is constituted by the substantially horizontal straight line interconnecting the two bases.

In a second embodiment, a said second rigid pipe is a catenary type pipe constituted by the end of a said second undersea pipe resting on the sea bottom rising to below the surface following a catenary curve with essentially continuously variable curvature up to said second float. In this embodiment, the bearing and the ground contact point that varies significantly with movements of the top portion of said catenary, from which said catenary second pipe (SCR) rises to beneath the surface, serves to stabilize the base of said catenary in a zone that is limited, and that thus acts like a second base. In this embodiment, it is the vertical riser that stabilizes said second rigid pipe of the SCR type without it being necessary for the top of said SR type pipe to be stabilized by a cable or a tie anchored to the sea bottom.

Nevertheless, in a bottom-surface connection of the invention, said first float is preferably connected to the sea bottom via a third base anchored by at least a first link, said first base being positioned between said third base and said second rigid pipe.

Said first link acts as a stay relative to the hybrid riser tower enabling it to be stabilized by compensating the horizontal tension created by said second rigid pipe, which tension tends to move said first float away from the floating support, as explained below.

In an advantageous variant embodiment, the bottom-surface connection installation of the invention comprises two of said rigid pipes each constituted by a said catenary type pipe rising to below the surface following a catenary curve with curvature that is essentially continuously variable, up to two of said second floats, and at least one of said two second floats is fastened to said first float, the other second floats being fastened to one of said first and second floats.

In another advantageous embodiment variant, the bottom-surface connection installation of the invention comprises two assemblies, each comprising a said hybrid tower and a said catenary type second rigid pipe, the two assemblies being connected to a common floating support and being disposed substantially symmetrically on either side of said floating support by means of a substantially horizontal second link.

In another advantageous variant of the invention, the bottom-surface connection installation of the invention comprises two assemblies, each comprising two said hybrid towers, the two assemblies being connected to a common floating support and being disposed substantially symmetrically on either side of said floating support by a second substantially horizontal link.

More particularly, the bottom-surface connection installation of the invention comprises an assembly comprising:

- two said hybrid towers with two said vertical risers having said first floats fastened against each other; and
- two said second rigid pipes of catenary type rising to below the surface along a catenary curve with essentially continuously variable curvature up to two of said second floats;
- said two second floats being fastened respectively to said two first floats. In other words, each second float is fastened to a different said first float, with the two first floats being fastened together.

In order to optimize space in the working of the oil field, it is then possible to put a plurality of installations of the invention into place that are respectively constituted by said assemblies of one or two hybrid towers, each having a single riser associated with one or two rigid catenary pipes, each assembly constituting a kind of operating island.

The relative stability and the small movements of these assemblies or islands make it possible to install them at relatively small distances apart, and in particular at less than 50 m from one another.

In a preferred embodiment, said floats are fastened together by fastener means situated level with two points on each float, said two points being spaced apart vertically so as to constrain the two floats to move together, preferably fastener means situated at two points that are close respectively to the top and bottom ends of cylindrical tanks constituting said floats.

Also advantageously, the at least two said floats that are fastened together are inserted inside a peripheral screen of hydrodynamic shape, preferably of cylindrical shape.

Said connection pipe between the floating support and the top end of the vertical riser may be:

- a flexible pipe or a pipe of small stiffness if the top float is close to the surface; or
- a pipe of steel that is thick, and therefore rigid, if the top float is at greater depth.

To connect the flexible pipes to said rigid pipe or riser, swan-neck type devices known to the person skilled in the art are interposed between them, with an improved example thereof being described in FR 2 809 136 in the name of the Applicant.

In an advantageous variant embodiment, the connection points of said first flexible connection pipe and second flexible connection pipe to the top ends respectively of said first rigid pipe and said second rigid pipe are situated at different depths, and one of said first and second flexible connection pipes is situated under the other of said flexible connection pipes, and preferably presents a length and curvature that are greater for the lower flexible connection pipe.

This configuration makes it possible to avoid impacts between the first and second flexible connection pipes when they are caused to move under the effect of swell, currents, and/or the movement of the floating support.

In another variant embodiment, the connection points of said first and second flexible connection pipes with the top ends respectively of the vertical riser and of the rigid SCR type pipe are at substantially the same depth, and the two flexible pipes are of substantially the same length, and of substantially the same curvature, being connected to each other so as to be substantially secured to each other, so that, where appropriate, they are subjected to movements synchronously, thereby avoiding any interference or impacts between the two flexible pipes in the event of movements associated with swell, currents, and/or the movements of the floating support.

In another aspect, the present invention also provides a method of laying an installation of the invention at sea, the method being characterized in that it comprises the following steps:

1) from a laying vessel on the surface, assembling a said vertical riser that is lowered and anchored to the sea bottom with a said first base, and tensioning the top thereof by means of a first float immersed under the surface, and connecting the bottom end of said riser to the end of a said first undersea pipe resting on the sea bottom; and 2) from a laying vessel on the surface, assembling a said second rigid pipe that is tensioned at its top end by a said second float immersed under the surface, and where appropriate when said second rigid pipe is a vertical riser, connecting the bottom end of said riser to the end of a said second undersea pipe resting on the sea bottom; and 3) bringing and fastening together said first and second floats; and 4) preferably stabilizing said first float by means of at least one said first and/or second link; and 5) placing said connection pipes between said riser and second rigid pipe at one end and a common floating support at the other end.

Where appropriate, in step 2), said second rigid pipe constituted by a vertical riser is anchored to a second base that is independent and spaced apart from said first base by at least 25 m.

According to another more particular aspect, the present invention provides a method of operating an oil field with the help of at least one installation of the invention, in which fluids are transferred between a floating support and undersea pipes resting on the sea bottom, said fluids including oil, and preferably with the help of a plurality of said installations, in particular three to twenty of said installations of the invention all connected to the same floating support.

In known manner, in order to connect together the various pipes, connection elements are used, in particular of the automatic connector type, relying on locking between a male portion and a complementary female portion, said locking being designed to be performed very simply at the bottom of the sea with the help of a remotely-operated vehicle (ROV), i.e. a robot that is controlled from the surface without requiring any direct manual intervention by people.

BRIEF DESCRIPTION OF THE DRAWINGS

Other characteristics and advantages of the present invention appear in the light of the following detailed description of embodiments given with reference to FIGS. 1 to 6:

FIGS. 1*a*-1*b* and 2*a* are a face view and FIG. 2*b* is a side view showing the various stages of putting a bottom-surface installation into place that comprises two undersea pipes 10*a*, 10*b* resting on the sea bottom, and in particular at great depth, the installation comprising:

DETAILED DESCRIPTION OF THE PRESENTLY PREFERED EMBODIMENTS 1) a first hybrid tower comprising:

a) a vertical riser 1*a* having its bottom end secured to a first base 3*a* anchored to the sea bottom and connected to a said undersea pipe 10*a* resting on the sea bottom, and having its top end connected to a first float 2*a* that is immersed under the surface, preferably at a depth of at least 50 m; and b) a first connection pipe 4*a*, preferably a flexible pipe, providing a connection between a floating support 11 and the top end of said riser; and 2) a second rigid pipe 1*b* of the vertical riser type having its bottom end fastened to a second base 3*b* anchored to the sea bottom independent from said first base 3*a*, and connected to a second said undersea pipe 10*b* resting on the sea bottom, and rising from said second undersea pipe resting on the sea bottom to which its bottom end is connected, up to below the surface, where its top end is connected to at least a respective second connection pipe 4*b*, that is preferably flexible, providing a connection with the same said floating support 11. The bottom end of each riser 1*a*, 1*b* is anchored to a distinct base 3*a*, 3*b*, and the top end of each vertical riser 1*a*, 1*b* is connected respectively to a first float 2*a*, and to a second float 2*b* that is situated substantially at the same depth as said first float 2*a* and that is secured to said first float.

The said first and second bases 3*a*, 3*b* include suction anchors embedded into the sea bottom and they are spaced apart by a distance L1 of about 40 m.

Each of the hybrid riser towers includes a flexible pipe 4*a*, 4*b* connected to the top end of said riser via a swan-neck type device 7. To clarify the explanation, the FPSO 11 and the swan neck 7 are not shown in the background of the face views, but are shown in detail in the side views of FIGS. 2*b*, 4 and 5.

Figures 1A, 1B:
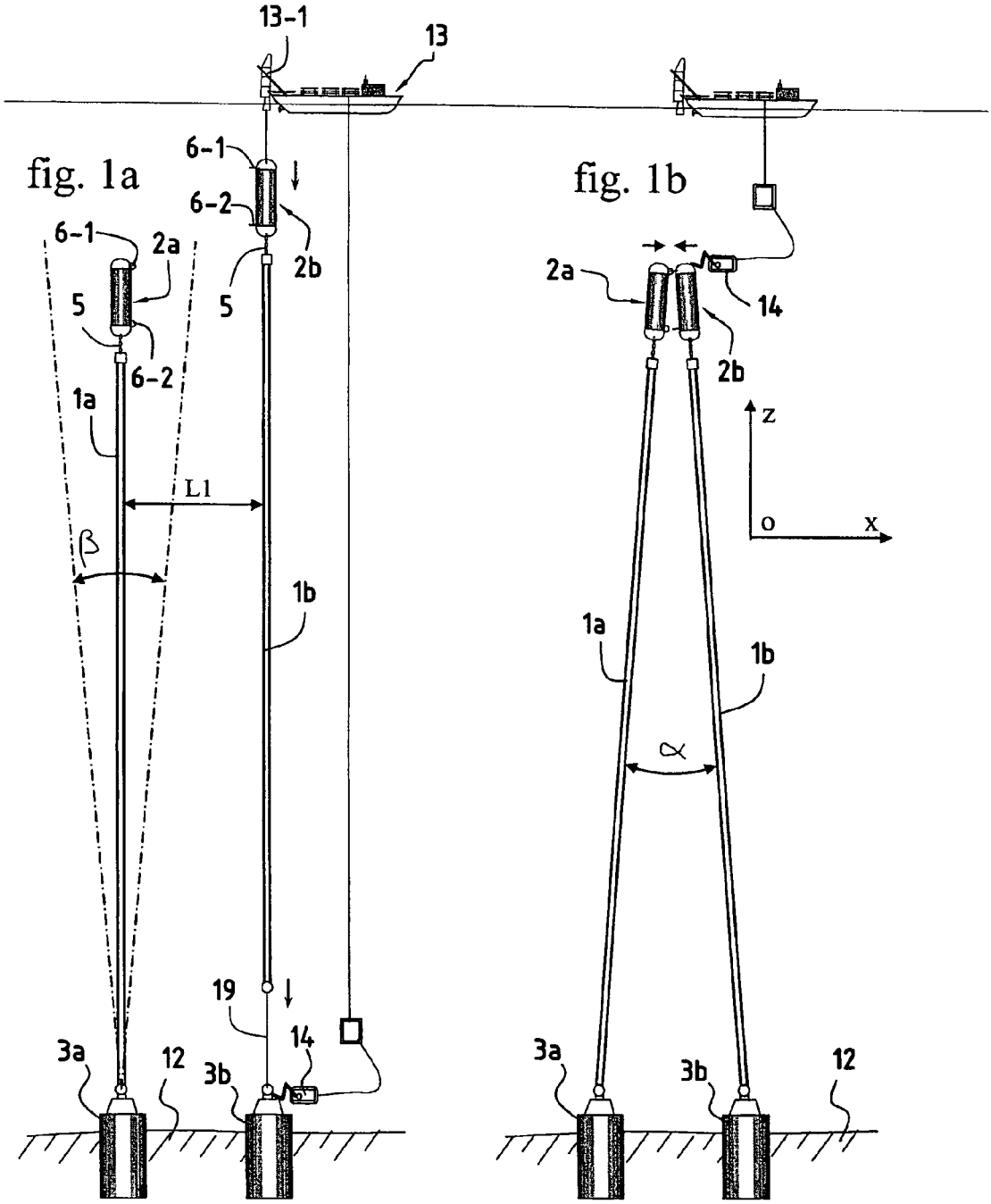
FIG. 1*a* is a face view of two hybrid towers being installed by a surface vessel at a small distance from each other.
FIG. 1*b* is a detailed face view showing the top portions of the two floats of the FIG. 1*a* risers moved towards each other and connected together by means of an ROV.

In FIG. 1*a*, the riser 1*a* is installed on the sea bottom, while the second riser 1*b* is being installed from a surface vessel 13 fitted with a J-lay tower 13-1. The assembly comprising the vertical pipe 1*b*, a chain 5, and the second float 2*b* is lowered towards the suction anchor 3*b* with the help of handling means on said surface vessel, and simultaneously a winch (not shown) is operated from the surface by an ROV 14 so as to tension a cable 19 and thus bring the bottom end of the riser 1*b* towards its base 3*b* where it is subsequently looked in conventional manner with the help of said ROV. This is made easier by the fact that simultaneously the top end of the pipe is tensioned by a float along the axis thereof.

When the riser 1*a* has been installed on the sea bottom, and when it is connected in individual manner to the FPSO 11 by a flexible pipe 4*a*, then under the effect of the displacements of said FPSO on the surface where it is subjected to swell, wind, and current, said hybrid tower is displaced substantially within a cone having an angle at the vertex of β. If it is desired to install two hybrid towers in such a manner as to avoid interference between their two risers, it is then necessary for them to be installed at a considerable distance apart, e.g. 60 m to 100 m, in order to ensure that their floats do not come into contact with each other. In the device of the invention, two hybrid riser towers are thus installed at a small distance apart by using floats that are fitted with fastener means 6-1, 6-2 enabling them to be connected to each other at least two locations that are spaced apart in the vertical direction, thus making it simple and easy to anchor and install said two risers and then to secure their two floats together, as shown in FIG. 1*b*. For this purpose, using a winch (not shown) that is installed on the ROV 14, the tops of said two floats 2*a* and 2*b* are moved towards each other substantially in the plane XoZ, and are then locked together at 6-1, after which the ROV is moved towards the bottom of said floats so as to bring the bottom portions of said floats towards each other in the same manner by means of the winch, and then lock them together at 6-2, so as to obtain the final configuration shown in face view in FIG. 2*a*. It is therefore necessary for the floats to be previously equipped with the means for fastening them to each other. For this purpose, the floats present internal reinforcements, e.g. circular stiffeners, or indeed solid or perforated internal partitions that are situated level with the fastener means so as to transmit between both said floats all of the forces generated by swell, wind, and currents acting on all of the components and on the FPSO. Said fastener means are either plates that are assembled together by divers using bolts, if their underwater depth is sufficiently shallow, or else, and preferably, they are automatic connectors that are actuated by an ROV under control from the surface.

The two risers 1*a*, 1*b* form between them an angle α of 1° to 10°, due to the spacing between their bases 3*a*, 3*b*. Thus, in the event of differential expansion due to different temperatures existing in each of the vertical pipes, the two bottom-surface connections that are fastened together at a high point, but that have different anchor points that are spaced apart from each other, give rise to deformation in the triangle having the vertex angle α and a base line constituted by the substantially horizontal straight line interconnecting the two bases. Thus, if the configuration shown in the figure corresponds to two risers 1*a* and 1*b* at the same temperature, then when the riser 1*a* is hot while the riser 1*b* remains cold, the triangle deforms, and its vertex constituted by the floats 2*a* and 2*b* moves to the right in the figure, with this deformation not being possible in the above-described prior devices.

Figures 2A, 2B:
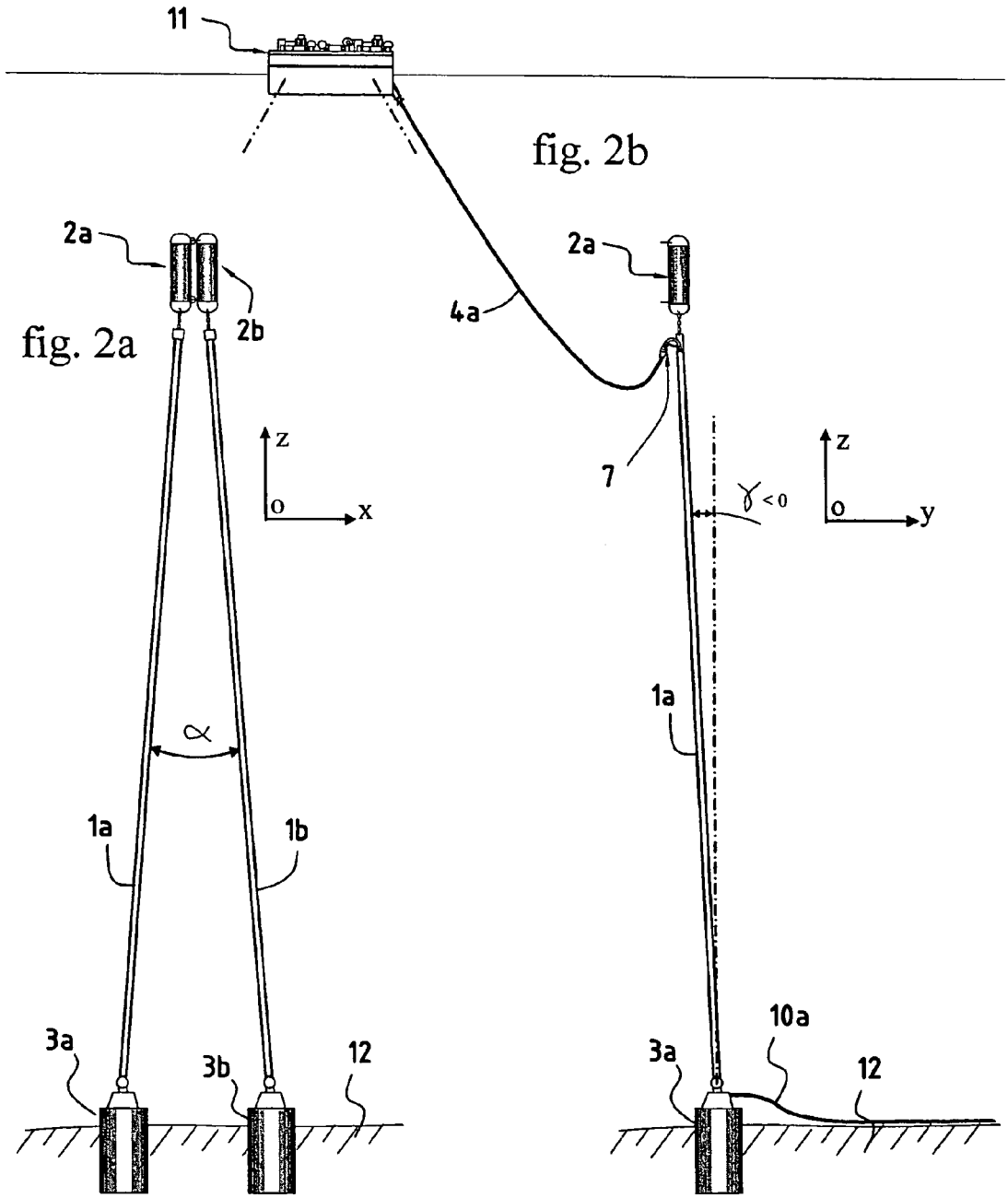
FIG. 2*a* is a face view showing the final state of two hybrid towers after their two floats have been connected together.
FIG. 2*b* is a side view associated with FIG. 2*a* showing the position of the anchored FPSO on the surface.

Finally, the flexible connection pipes 4*a*, 4*b* that are secured to the FPSO 11 are connected to the ends of the swan necks 7 at the tops of the vertical pipes. Before installing said flexible connection pipes, the assembly comprising two risers lies substantially in the vertical plane ZoX, but the flexible connection pipes generate horizontal tension that stabilizes the assembly, tending to move the assembly of the two hybrid riser towers towards said FPSO, through an angle γ that is negative in the ZoY plane, as can be seen in FIG. 2*b*.

Figures 3, 3A, 3B:
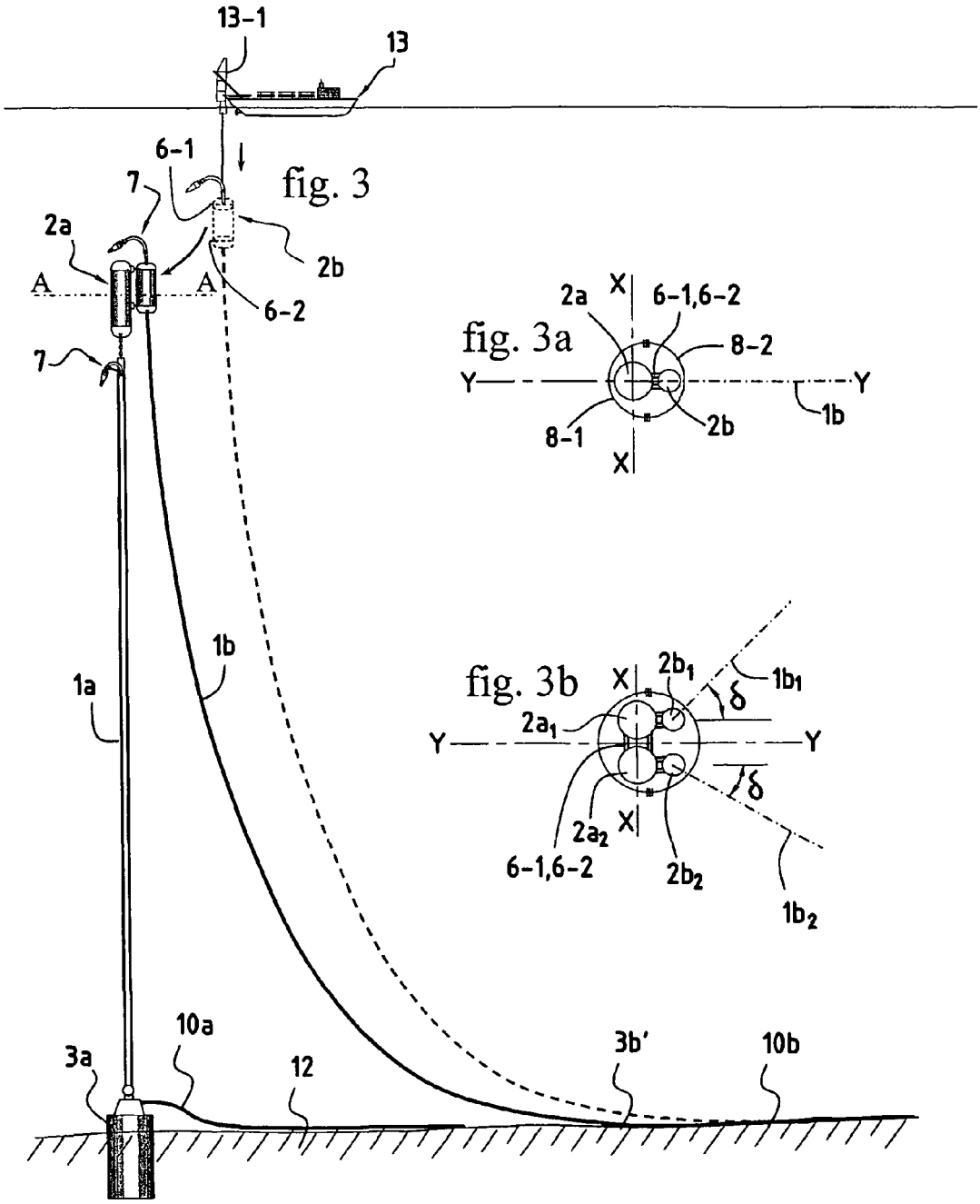
FIG. 3 is a side view of a hybrid tower having connected thereto an SCR type pipe that is fitted with its own individual float.
FIGS. 3*a* and 3*b* are sections on plane AA of FIG. 3 showing two types of assembly, respectively of an SCR to a hybrid tower (3*a*), and of two SCRs each having its own individual float, and connected respectively to twin hybrid towers (3*b*)
Figure 4:
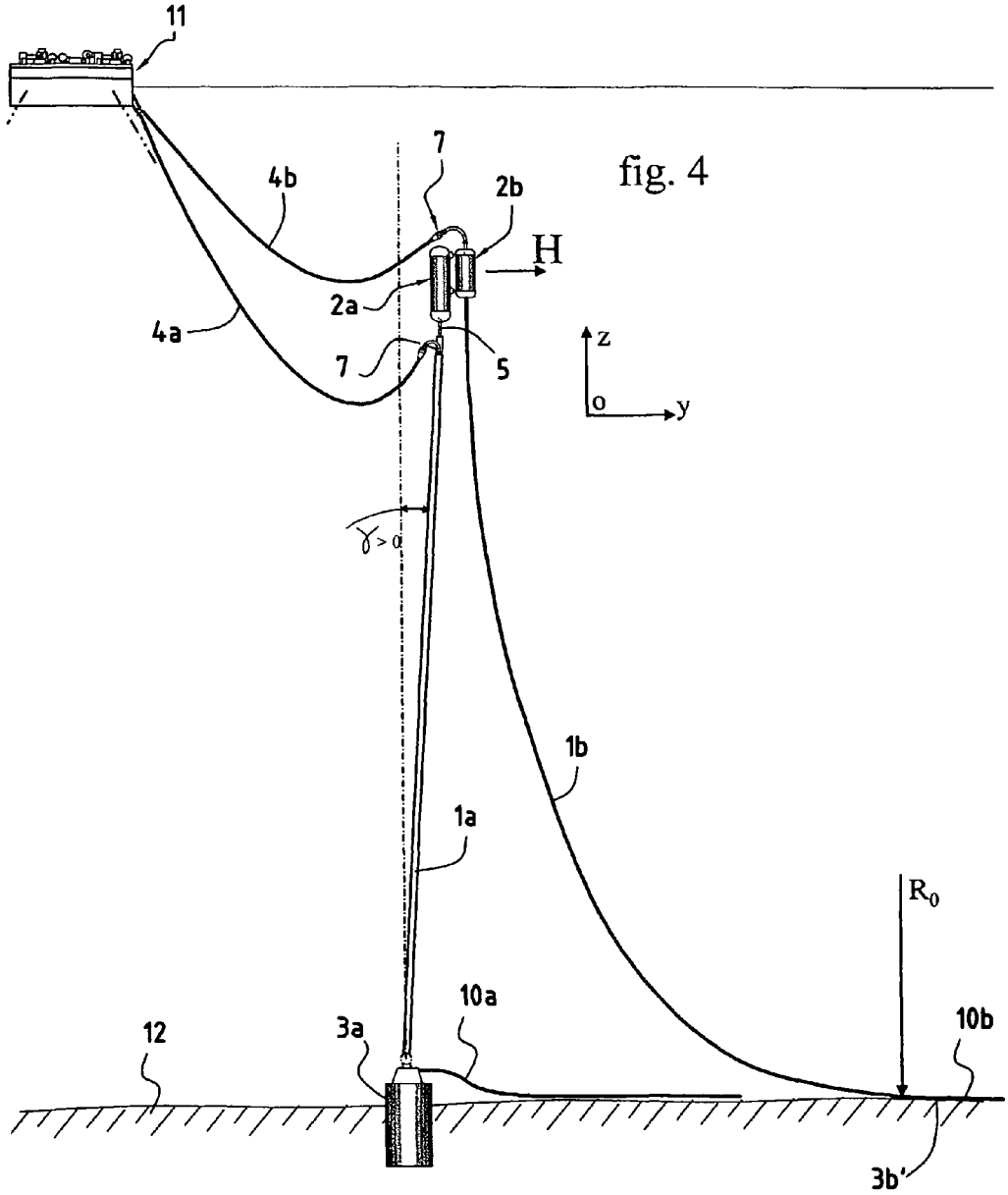
FIG. 4 is a side view associated with FIG. 3 at the end of installation showing connections with the FPSO.
Figure 5:
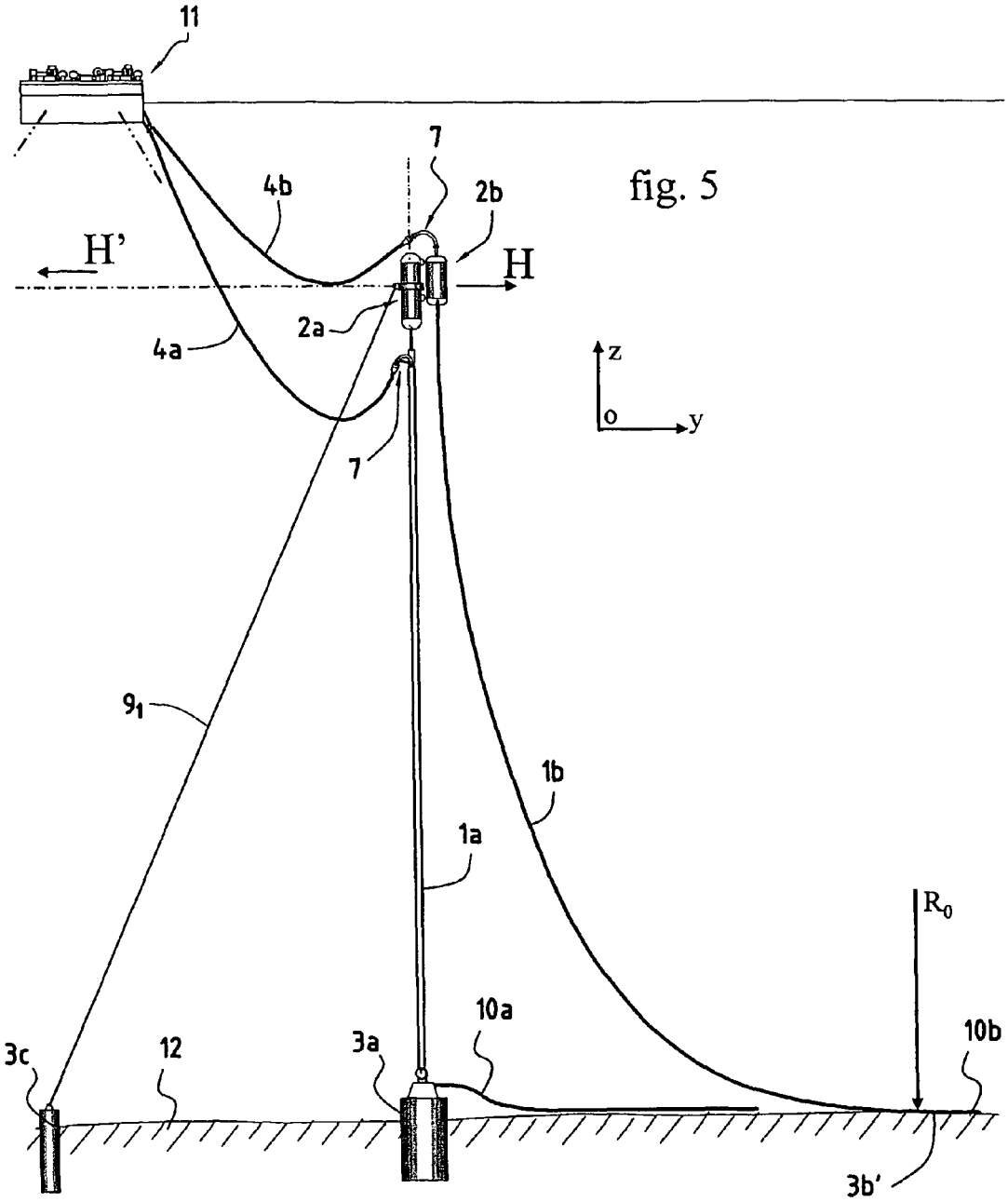
FIG. 5 is a side view of a hybrid tower of the kind shown in FIG. 4 having an SCR type pipe connected together that is fitted with its own individual float, and that is stabilized in a substantially vertical position by an anchor cable type link.

In FIGS. 3, 4, and 5, there is shown a second embodiment in which a bottom-surface connection installation for two undersea pipes 10*a*, 10*b* resting on the sea bed, in particular at great depth, comprises:

1) a first hybrid tower comprising:

a) a vertical riser 1*a* having its bottom end secured to a first base 3*a* anchored to the sea bottom and connected to a said undersea pipe 10*a* resting on the sea bottom, and having its top end connected to a first float 2*a* that is immersed under the surface, preferably at a depth of at least 100 m; and b) a first connection pipe 4*a*, preferably a plunging flexible pipe, providing a connection between a floating support 11 and the top end of said riser; and 2) a second said rigid pipe of the catenary type 1*b* constituted by the end of a second said undersea pipe 10*b* resting on the sea bottom and rising to below the surface, following a catenary curve in which curvature varies essentially continuously, up to said second float.

In FIG. 3 there can be seen a side view of the riser 1*a* of the hybrid tower where the surface vessel 13 is installing an SCR type rigid pipe 1*b* fitted with its own float 2*b*, said SCR type pipe passing through said float 2*b* and terminating at its top end in a swan neck 7. During the final stage of said second float 2*b* approaching said first float 2*a* of the hybrid tower, the two floats are locked together at a high point 6-1 and at a low point 6-2.

FIG. 3*a* is a plan view in section on plane AA of FIG. 3 showing in detail how an SCR 1*b* is assembled to a single hybrid tower, with a screen 8 of hydrodynamic profile, preferably of circular section, surrounding the float assembly so as to minimize the hydrodynamic forces due to current and to swell.

FIG. 3*b* is a plan view in section on plane AA of FIG. 3 showing in detail how two SCRs 1*b*1, 1*b*2 each fitted with its own float 2*b*1, 2*b*2 are assembled, the said two SCRs preferably being disposed symmetrically in a plane to form an angle δ, e.g. 30°, preferably symmetrically relative to the vertical plane ZoY.

As shown in FIG. 4, the SCRs 1*b* is/are disposed on the side of the riser 1*a* that is furthest from the FPSO 11, for obvious reasons associated with available space constraints, and said SCRs 1*b* deliver a large amount of horizontal tension H tending to move the two floats 2*a*, 2*b* away from the FPSO 11, so that the hybrid tower(s) of the riser(s) 1*a* then slope(s) at a positive angle γ.

The fact that the SCRs are offset from the ZoY plane by an angle δ makes it possible to reduce the overall value of the tension H, since only the projection of said horizontal tension from each of said SCRs onto the plane ZoY contributes to said tension H, with the projections of the respective horizontal tensions of said SCRs onto the plane XoZ canceling. Thus, increasing said angle δ serves to minimize the overall horizontal tension H, but presents the drawback of increasing the "footprint" or sea bed area occupied, thereby going against the initially desired objective of being able to install a maximum number of pipes in a limited space; this therefore leads to a compromise between the overall level of horizontal tension H and the footprint.

In a preferred version of the invention as shown in FIG. 5, a link 9-1 is advantageously installed having its top end secured to the main float 2*a* and its bottom end secured to a gravity anchor or suction anchor 3*c*, thus constituting a tie. This tie thus acts as a stay and compensates the horizontal tension H, thereby enabling the angle γ to be stabilized at some arbitrary value, e.g. γ=0, as shown in FIG. 5, and thus presenting substantially all movement of the floats 2*a*, 2*b* and of the pipes 1*a*, 1*b* in the axial ZoY plane of the two pipes.

Figure 5A:
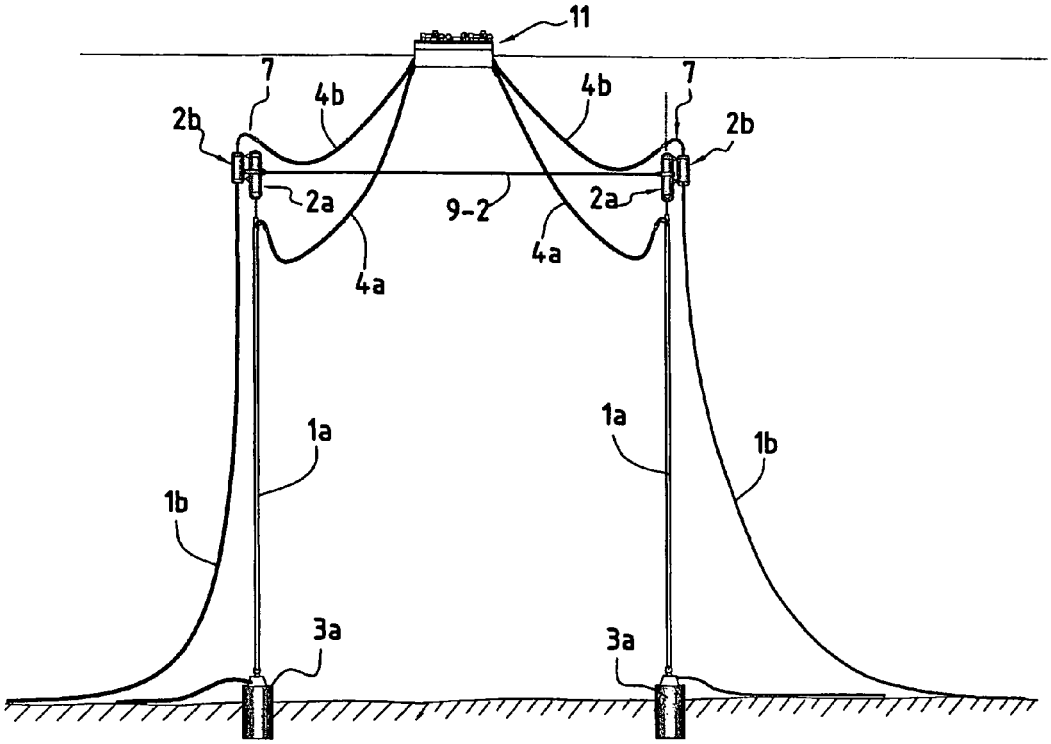
FIG. 5*a* is a side view of a floating support having two hybrid tower assemblies 1*a* connected thereto, each connected to an SCR or catenary pipe 1*b* and disposed on either side of said floating support.

In a preferred version of the invention, shown in FIG. 5*a*, the bottom-surface connection installation of the invention comprises two assemblies each comprising a said hybrid tower with a single riser 1*a* and a second rigid pipe 1*b* that is of the catenary type, the two assemblies being connected to a common floating support (11) and disposed substantially symmetrically on either side said floating support, being interconnected by a second substantially horizontal link (9-2) thus constituting a horizontal tie serving to compensate said opposing horizontal forces H and H'.

Figure 6A:
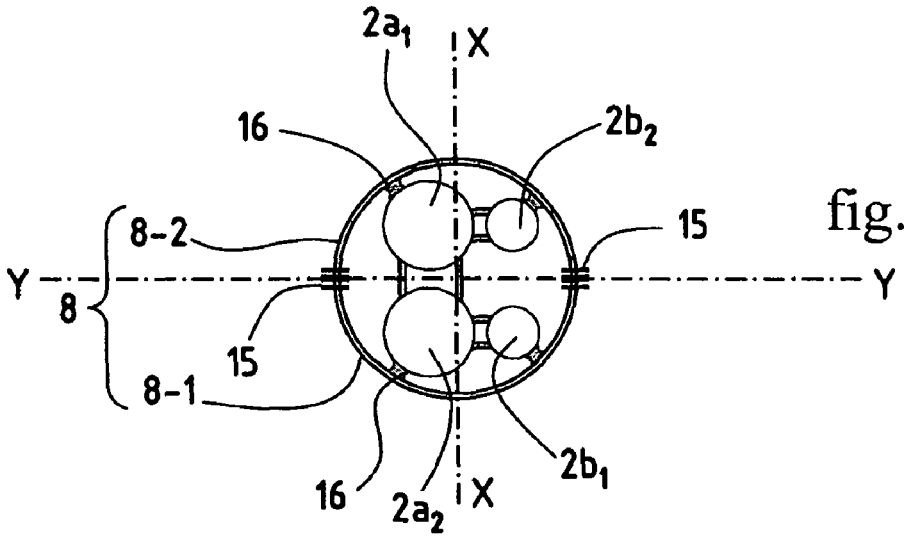
FIG. 6*a* is a section on plane AA of FIG. 3 showing how the cylindrical fairing is secured on the various floats to act as a hydrodynamic screen.

FIG. 6*a* is a section on plane AA of FIG. 3 relating to the configuration of FIG. 3*b*, showing a circular section cylindrical screen 8 made up of two half-shells 8-1 and 8-2 that are assembled together at 15, said half-shells being secured to said floats via elastomer links 16. This screen provides a hydrodynamic profile that advantageously extends over the entire height of the floats, themselves constituted by cylindrical tanks, so as to minimize the effects of swell and current, thereby considerably reducing the movements of the assembly, and as a result reducing problems of fatigue over the full lifetime of the installation, which can exceed 25 years to 30 years, or even more.

Figure 6B:
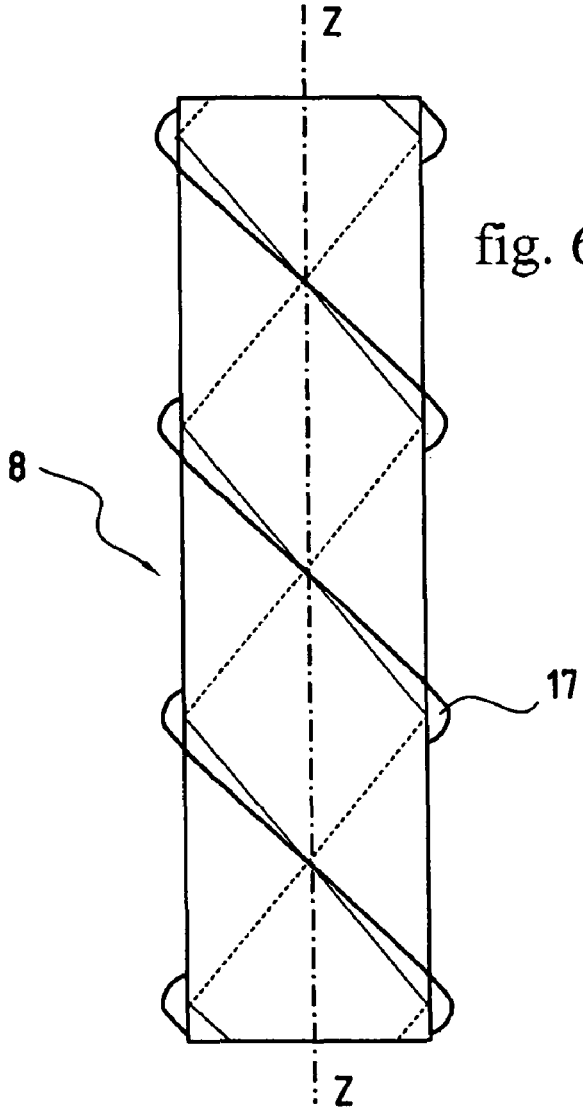
FIG. 6*b* is a side view of the cylindrical fairing for the floats fitted with anti-vortex fins.

FIG. 6*b* is a side view of the half-shells assembled to form a cylinder and fitted with anti-vortex fins 17 that are known to the person skilled in the art and that serve to avoid vibrational phenomena appearing, which phenomena are highly prejudicial to the fatigue strength of the various mechanical elements. In this figure, only the screens are shown, the floats, the pipes, and other accessories not being shown.

In FIGS. 3, 4, 5, and 5*a*, there can be seen the installation in which said first and second flexible connection pipe 4*a* and 4*b* are of different heights. The top portions of the second SCR type rigid pipes 1*b* pass through said second floats 2*b* and the connection points of said second flexible pipes 4*b* at the top ends of said second rigid pipes 1*b* are situated above said second floats 2*b*. In contrast, the top ends of said first rigid pipes constituted by the vertical risers 1*a* are connected to said floats by chains 5, such that the top ends of said vertical risers 1*a* and the connection points between said first flexible pipes 4*a* and the top ends of said vertical risers 1*a* are situated below said first floats 2*a*.

In this configuration, the two second flexible pipes or connection pipes 4*a*, 4*b*—having their opposite ends connected to the floating support at substantially the same height—form curves of different curvatures.

More precisely, the first flexible pipe 4*a* lies at all times below the second flexible pipe 4*b*, and the first flexible pipe 4*a* presents greater curvature, i.e. it plunges deeper than the second pipe 4*b*, with the first flexible pipe 4*a* being longer than the second flexible pipe 4*b*.

This avoids any interference between the two flexible pipes 4*a* and 4*b* when they are subjected to movements due to the effects of swell, current, and/or the movements of the floating support, and this applies in spite of the fact that two flexible pipes are independent in their movements.

In another embodiment not shown in the figures, it is possible to avoid interference between two flexible pipes 4*a*, 4*b* when they are in movement, by installing at the same depth and by connecting them to each other so as to constrain them to move together. Under such circumstances, the top ends of the first rigid pipes or vertical risers 1*a* and of the SCR type second rigid pipe 1*b*, and also the connection points of the two second flexible connection pipes 4*a* and 4*b*, are at substantially the same depth, and said flexible pipes 4*a* and 4*b* are of substantially the same length, with substantially the same curvature. Thus, both flexible pipes 4*a* and 4*b* are subjected to movements that are identical and do not interfere with each other and do not strike each other as they move.

What is claimed is:

1. A bottom-surface connection installation for at least two undersea pipes resting on the sea bed, the installation comprising:

a first hybrid tower comprising:

a first rigid pipe having a vertical riser with its bottom end fastened to a first base anchored to the sea bottom at a depth of at least about 1000 m and connected to a first said undersea pipe resting on the sea bottom, and having its top end tensioned in a substantially vertical manner by a first float immersed under the surface, at a depth of at least about 100 m, to which said top end is connected; and a first flexible connection pipe providing a connection between a floating support and the top end of said vertical riser; and at least one second rigid pipe rising from the sea bottom where it rests or from a second undersea pipe resting on the sea bottom and to which its bottom end is connected, to below the surface, where its top end is connected to at least one respective second flexible connection pipe connecting it with the same said floating support:

wherein the bottom end of said at least one second rigid pipe is not anchored to said first base;

wherein the top end of said at least one second rigid pipe is connected respectively to a second float situated substantially at the same depth as said first float and fastened rigidly to said first float, one against the other; and wherein said second rigid pipe is selected from the group consisting of a catenary pipe constituted by the end of a said second undersea pipe resting on the sea bottom rising to below the surface following a catenary curve with essentially continuously variable curvature up to said second float; and a second vertical riser, having its bottom end fastened to a second base anchored to the sea bottom independent from said first base and connected to a second undersea pipe resting on the sea bottom; and wherein both said first and second bases comprise anchors embedded in the sea bottom and spaced apart, so that the two vertical risers form between them an angle $\alpha$ of from about 1° to about 10°.

2. The bottom-surface connection installation according to claim 1, wherein a said second rigid pipe is constituted by said second vertical riser and said second base is at a distance of no more than 50 m from said first base.

3. The bottom-surface connection installation according to claim 2, wherein said first and second bases include suction anchors embedded in the sea bottom.

4. The bottom-surface connection installation according to claim 2 wherein it comprises two assemblies each comprising two said hybrid towers, the two assemblies being connected to a common floating support and being disposed substantially symmetrically on either side of said floating support by a second substantially horizontal link.

5. The bottom-surface connection installation according to claim 2, wherein said second base is situated at a distance of no less than about 25 m from said first base.

6. The bottom-surface connection installation according to claim 1, wherein said second rigid pipe is said catenary pipe.

7. The bottom-surface connection installation according to claim 6, wherein said first float is connected to the sea bottom via a third base anchored by at least a first link, said first base being positioned between said third base and said second rigid pipe.

8. The bottom-surface connection installation according to claim 6 wherein two of said second rigid pipes are each constituted by a said catenary pipe rising to below the surface following a catenary curve with curvature that is essentially continuously variable, up to two of said second floats, and at least one of said two second floats is fastened to said first float, the other second floats being fastened to one of said first and second floats.

9. The bottom-surface connection installation according to claim 1 wherein it comprises two assemblies, each comprising a said hybrid tower and a said catenary type second rigid pipe, the two assemblies being connected to a common floating support and being disposed substantially symmetrically on either side of said floating support by means of a substantially horizontal second link.

10. The bottom-surface connection installation according to claim 1, wherein it comprises an assembly comprising:

two said hybrid towers with two said vertical risers having said first floats fastened against each other; and two said second rigid pipes of catenary rising to below the surface along a catenary curve with essentially continuously variable curvature up to two of said second floats said two second floats being fastened respectively to said two first floats.

11. The bottom-surface connection installation according to claim 1 wherein said floats are fastened together by fastener means situated level with two points on each float, said two points being spaced apart vertically so as to constrain the two floats to move together.

12. The bottom-surface connection installation according to claim 1, wherein the at least two said floats that are fastened together are inserted inside a peripheral screen of hydrodynamic shape.

13. The bottom-surface connection installation according to claim 1 wherein the connection points of said first flexible connection pipe and second flexible connection pipe to the top ends respectively of said first rigid pipe and said second rigid pipe are situated at different depths, and one of said first and second flexible connection pipes is situated under the other of said flexible connection pipes.

14. The bottom-surface connection installation according to claim 13 wherein one of said first and second flexible connection pipes is situated under the other of said flexible connection pipes and presents a length and curvature that are greater for the lower flexible connection pipe.

15. A method of laying at sea an installation according to claim 1, the method comprising the following steps:

from a laying vessel on the surface, assembling a said vertical riser that is lowered and anchored to the sea bottom with a said first base, and tensioning the top thereof by means of a first float immersed under the surface, and connecting the bottom end of said riser to the end of a said first undersea pipe resting on the sea bottom;

from a laying vessel on the surface, assembling a said second rigid pipe that is tensioned at its top end by a said second float immersed under the surface, and where appropriate when said second rigid pipe is a vertical riser, connecting the bottom end of said riser to the end of a said second undersea pipe resting on the sea bottom;

bringing and fastening together said first and second floats; and placing said connection pipes between said riser and second rigid pipe at one end and a common floating support at the other end.

16. The method of laying at sea an installation according to claim 15, the method comprising the following additional step:

stabilizing said first float by means of at least one link.

17. A method of operating an oil field with the help of at least one installation according to claim 1, in which fluids are transferred between a floating support and undersea pipes resting on the sea bottom, said fluids including oil.

18. The method of operating an oil field according to claim 17, wherein a plurality of said installations are used.

19. A bottom-surface connection installation for at least two undersea pipes resting on the sea bed, at a depth of at least about 1000 m, the installation comprising:

a first hybrid tower comprising:

a first rigid pipe having a vertical riser with its bottom end fastened to a first base anchored to the sea bottom and connected to a first said undersea pipe resting on the sea bottom, and having its top end tensioned in a substantially vertical manner by a first float immersed under the surface, at a depth of at least about 100 m, to which said top end is connected; and a first flexible connection pipe providing a connection between a floating support and the top end of said vertical riser; and at least one second rigid pipe rising from the sea bottom where it rests or from a second undersea pipe resting on the sea bottom and to which its bottom end is connected, to below the surface, where its top end is connected to at least one respective second flexible connection pipe connecting it with the same said floating support:

wherein the bottom end of said second rigid pipe is not anchored to said first base; and wherein the top end of said second rigid pipes is connected respectively to a second float situated substantially at the same depth as said first float and fastened rigidly to said first float, one against the other;

wherein a said second rigid pipe is constituted by a second vertical riser, having its bottom end fastened to a second base anchored to the sea bottom independent from said first base and connected to a second undersea pipe resting on the sea bottom; and wherein both first and second bases comprise anchors embedded in the sea bottom and spaced apart, so that the two vertical risers form between them an angle $\alpha$ of from about 1° to about 10°.

* * * * *